US005947638A

United States Patent [19]

Heims

[11] Patent Number: 5,947,638

[45] Date of Patent: Sep. 7, 1999

[54] METHOD OF COMPACTING ASPHALT MIX

[75] Inventor: Dirk Heims, Bad Münder, Germany

[73] Assignee: ABG Allgemeine Baumaschinen-Gesellschaft mbH, Hameln, Germany

[21] Appl. No.: 08/879,090

[22] Filed: Jun. 19, 1997

[51] Int. Cl.[6] ..... E01C 19/38; E01C 19/30

[52] U.S. Cl. ..... 404/102; 404/133.05

[58] Field of Search ..... 405/271; 404/102, 404/113, 114, 133.05, 133.2; 299/37.3, 37.4, 37.5; 173/101

[56] References Cited

U.S. PATENT DOCUMENTS

| | | | |
|---|---|---|---|
| 4,502,813 | 3/1985 | Hojberg . | |
| 4,507,014 | 3/1985 | Heims et al. | 404/102 |
| 4,828,428 | 5/1989 | Anderson . | |
| 5,165,820 | 11/1992 | Bunk et al. . | |
| 5,516,231 | 5/1996 | Heims et al. . | |

FOREIGN PATENT DOCUMENTS

| | | | |
|---|---|---|---|
| 0 115 567 | 8/1984 | European Pat. Off. . | |
| 0 658 653 | 6/1995 | European Pat. Off. . | |
| A0629960 | 5/1936 | Germany | 404/133.05 |
| 3248172 | 6/1984 | Germany | 404/133.05 |
| 1142568 | 2/1985 | Russian Federation | 404/102 |

*Primary Examiner*—Tamara Graysay
*Assistant Examiner*—Sunil Singh
*Attorney, Agent, or Firm*—John J. Selko

[57] ABSTRACT

A method of compacting asphalt material having a mix of coarse and fine grains includes providing a paver which has, as compaction assemblies, two strip-shaped tampers which are arranged one directly behind the other in the direction of travel, each tamper being provided with a metering slope and each tamper being provided with a tamping surface thereon, each tamper being vertically reciprocated between an upper and lower terminal position, so as to cause the front tamper lower position to correspond substantially to the rear tamper upper position, whereby coarser grains in the asphalt mix are embedded and undergo minimal longitudinal displacement, as the paver moves.

9 Claims, 1 Drawing Sheet

METHOD OF COMPACTING ASPHALT MIX

BACKGROUND OF THE INVENTION

The invention relates to a method of operating a mobile paver to compact an asphalt mix, and more particularly to a method of compacting a layer of asphalt material containing a mixture of particle of larger and smaller sizes.

Asphalt mix with a high coarse-grain proportion (in particular order of magnitude 30 mm or more) with at the same time a lack of or reduced proportion of medium grain size is problematic during paving using pavers which have at least one tamper and an adjoining screed, since the coarse grain at the surface of the paving layer, does not remain embedded on all sides in the mix of smaller grain size, but approximately crescent-shaped openings of greater or lesser width occur after the coarse grain, seen in the direction of travel of the paver. These openings can no longer be closed even by subsequent roller compaction.

In pavers of this type, the tampers usually have a metering slope in order to act in a metering manner on the mix to be used f or paving, in which case, in the event of tampers of this type being used as a pair, the front tamper in the direction of travel brings about precompaction to a lower height than the subsequent tamper which, however, likewise operates in a metering manner, while subsequently smoothing takes place by the screed and, if appropriate, additional compaction.

It is assumed in general that loose paving material is compacted by about 25% by a paver and, if appropriate, by subsequent rolling in order to achieve the paving state. In many cases, this final compaction cannot be achieved by a paver alone, which uses tampers and a screed, as is the case in a paver according to EP-A-0 115 567, but requires additional rolling to bring about approximately 5 to 10% of the compaction which, however, depends on the paving material. The loose paving material is usually applied with a layer thickness between about 3 and 30 cm (also depending on the type of paving material) and compacted, i.e. the total compaction is approximately within the range of 0.8 to 8 cm (=maximum stroke of the pair of tampers which is essentially halved between the front and rear tamper). In this case, this range is divided over the metering slope range of the pair of tampers in such a way that, f or example, in the upper position of the tampers, the metering slopes adjoin one another, i.e. essentially lie in a common plane. If this were not observed and if there were to be a considerable deviation therefrom, there would be the risk that the screed would be lifted out of its floating position and would not be able to undertake its smoothing function. Correspondingly, the rule also results: large strokes of the tampers for large layer thicknesses and small strokes of the tampers for small layer thicknesses, in each case with a staggered stroke setting of the tampers, arranged one behind the other, in the direction of travel.

Working in this manner, with asphalt mix, crescent-shaped openings form in the surface, as was described at the beginning, which openings can no longer be closed by rolling. Varying the tamper strokes within the range of the rules given to the person skilled in the art does not eliminate this problem. Higher paving temperatures or specific layer thicknesses or changes to the vibration amplitude of the screed or changes to the stroke frequency of the tampers, for example, do not achieve the objective either.

The foregoing illustrates limitations known to exist in present paving methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an improved method of compacting an asphalt mix having a mixture of coarse and smaller sized grains using a mobile paver having compaction assemblies comprising a first and second strip-shaped tamper positioned transverse to the direction of paver travel, each tamper having a generally horizontal tamping surface for compacting the asphalt mix, the second tamper being arranged directly behind the first tamper in the direction of paver travel, each tamper being provided with a metering slope, both tampers being capable of reciprocating vertically in opposite directions above a horizontal surface, the paver having a screed adjoining the tampers; reciprocating the first tamper in a stroke terminating vertically above the horizontal surface to position the first tamping surface, alternatively, at a first lower position and at a first upper position; reciprocating the second tamper in a stroke terminating vertically above the horizontal surface to position the second tamping surface, alternatively, at a second lower position and at a second upper position; and adjusting at least one tamper stroke range so as to cause the first lower position of the first tamper to correspond substantially to the second upper position of the second tamper, whereby coarser grains in the asphalt mix are embedded and undergo minimal longitudinal displacement, as the paver moves.

Owing to the fact that the paving is carried out with a stroke setting of the tampers in which the lower dead centre terminal position of the front tamper in the direction of travel corresponds substantially to the upper dead centre terminal position of the rear tamper in the direction of travel, the occurrence of crescent-shaped openings adjacent to the coarse grain near to the surface is avoided. This is apparently based on the fact that, with this setting of the tampers, the coarse grain located at the height of the later surface of the paving layer undergoes virtually no horizontal offset by the rear tamper moving with the paver in the direction of travel and is thus no longer carried along in the direction of travel of the paver, while it is pressed down to the paving height by the tamper. The coarse grain therefore remains embedded on all sides in the mix of smaller grain size, thus resulting in a closed paving layer.

The foregoing and other aspects will become apparent from the following detailed description of the invention when considered in conjunction with the accompanying drawing figures.

BRIEF DESCRIPTION OF THE DRAWING FIGURES

FIG. 1 is a schematic, partially cross-sectional side view of a paver, with parts removed, showing tampers and screed of a paver used in the practice of the invention.

DETAILED DESCRIPTION

Figure 1:
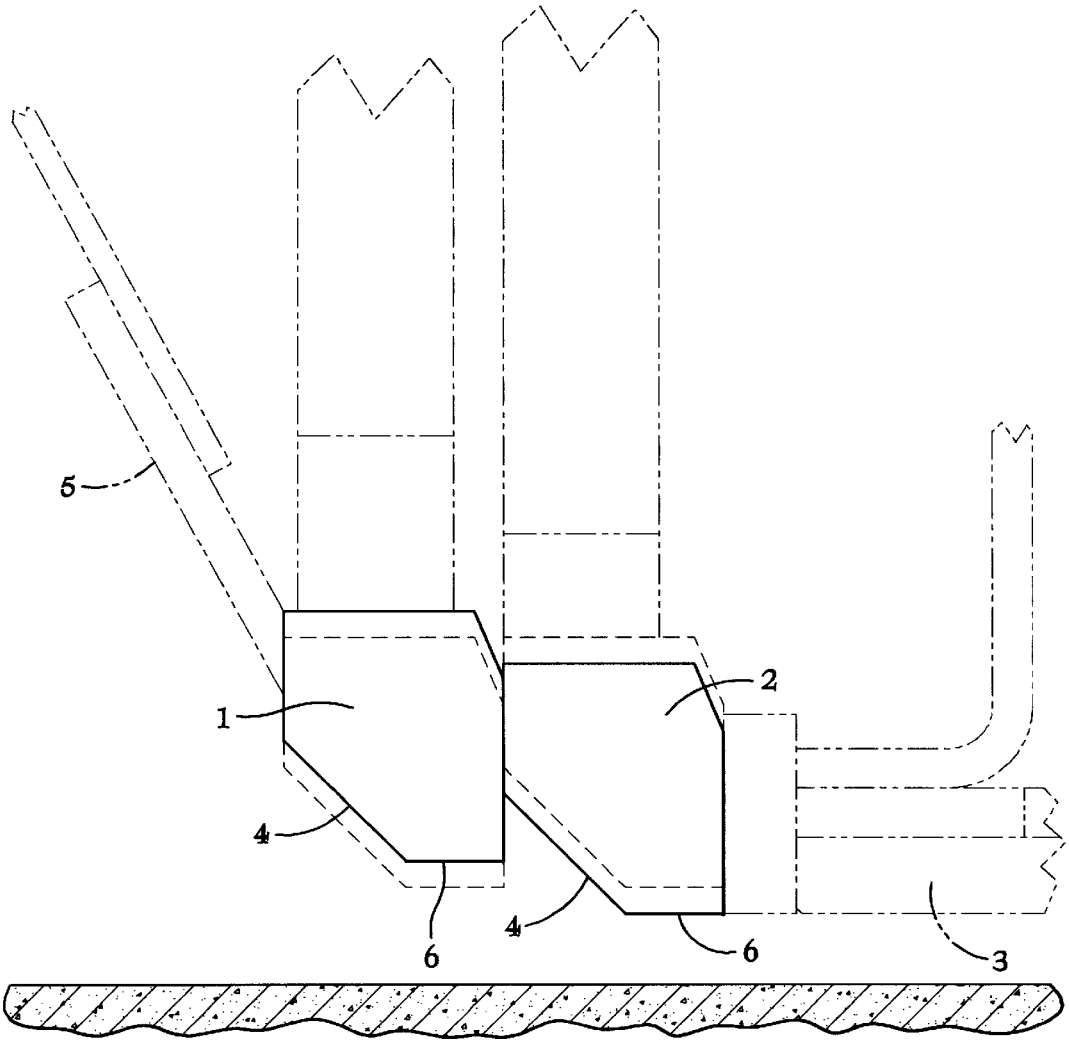

The compaction assembly illustrated, which is arranged after a distribution worm (not shown)for asphalt mix in the direction of travel, comprises two strip-shaped tampers 1, 2 which are arranged one directly after the other in the direction of travel and are driven in opposite directions by a drive (not illustrated) and a screed 3 which adjoins the said tampers and is coupled to a vibration drive (not illustrated) and then also has a compacting effect additionally. Both tampers 1, 2 are each provided with a metering slope 4 which runs approximately at an angle of 45° to the horizontal plane, while a guide plate 5 is provided in front of the tampers 1, 2 at an angle of about 60° to the horizontal plane, which guide plate bounds the distribution chamber for the mix to the rear in the direction of travel. A paver of this type is known, for example, from EP 0 115 567 B1.

In this case, the compaction assembly is attached in total to the paver by means of tension arms and floats on the mix to be compacted.

The upper dead centre position of the front tamper 1 is illustrated by solid lines, whereas its lower dead centre position is illustrated by dashed lines. Its stroke height is the height difference between these two terminal positions.

The lower dead centre position of the rear tamper is illustrated by solid lines, whereas its upper dead centre position is illustrated by dashed lines. It stroke height is the height difference between these two terminal positions.

It can be seen that the stroke setting of the two tampers 1, 2 has been selected such that the lower dead centre of the front tamper 1 in the direction of travel corresponds to, or substantially coincides with, the upper dead centre of the rear tamper 2 in the direction of travel, cf. the two dashed tamper positions.

It is thus achieved that the coarse grain is bedded in downwards by the front tamper 1 to the extent that the rear tamper 2 only brings about further compression of the layer with the lower part of its metering slope 4 and its horizontal tamper surface 6. In this way, is the coarse grain undergoes virtually no longitudinal displacement.

In this case, it is expedient for the stroke range of the front tamper 1 in the direction of travel to be slightly greater than that of the rear tamper 2 in the direction of travel.

A paver can be used to carry out the method, in which paver both tampers 1, 2 have independent eccentric drives with non-adjustable or adjustable strokes, or the front and/or the rear tamper 1, 2 has a vibration drive.

What is claimed:

1. An improved method of compacting an asphalt mix having a mixture of coarse and smaller sized grains using a mobile paver having compaction assemblies comprising a first and second strip-shaped tamper positioned transverse to the direction of paver travel, each tamper having a generally horizontal tamping surface for compacting the asphalt mix, the second tamper being arranged directly behind the first tamper in the direction of paver travel, each tamper being provided with a metering slope, both tampers being capable of reciprocating vertically in opposite directions above a horizontal surface, the paver having a screed adjoining the tampers, the improved method characterized by:

a. reciprocating the first tamper in a stroke terminating vertically above the horizontal surface to position the first tamping surface, alternatively, at a first lower position and at a first upper position;

b. reciprocating the second tamper in a stroke terminating vertically above the horizontal surface to position the second tamping surface, alternatively, at a second lower position and at a second upper position; and c. adjusting at least one tamper stroke range so as to cause the first lower position of the first tamper to correspond substantially to the second upper position of the second tamper, whereby coarser grains in the asphalt mix are embedded and undergo minimal longitudinal displacement, as the paver moves.

2. The method according to claim 1 further comprising:

a. providing a stroke range of the first tamper slightly greater than a stroke range of the second tamper.

3. The method according to claim 1 further comprising:

a. adjusting the stroke range of both the first and second tampers relative to one another.

4. The method according to claim 3 further comprising:

a. adjusting the stroke range of the first and second tampers independently of each other.

5. The method according to claim 1 further comprising:

a. vibrating one of the tampers during operation of the paver.

6. The method as recited in claim 1 wherein at least one of the tampers has an eccentric drive with an adjustable stroke and the step of adjusting at least one stroke range includes adjusting the eccentric drive to adjust the stroke of the one tamper.

7. An improved method of compacting an asphalt mix having a mixture of coarse and smaller sized grains using a mobile paver comprising:

a. providing on the paver compaction assemblies comprising a first and second stripshaped tamper positioned transverse to the direction of paver travel, each tamper having a generally horizontal tamping surface for compacting the asphalt mix, the second tamper being arranged directly behind the first tamper in the direction of paver travel:

b. providing each tamper with a metering slope;

c. providing both tampers with a capability of reciprocating vertically in opposite directions above a horizontal surface;

d. providing the paver with a screed adjoining the tampers;

e. reciprocating the first tamper in a stroke terminating vertically above the horizontal surface to position the first tamping surface, alternatively, at a first lower position and at a first upper position;

f. reciprocating the second tamper in a stroke terminating vertically above the horizontal surface to position the second tamping surface, alternatively, at a second lower position and at a second upper position; and g. adjusting at least one tamper stroke range so as to cause the first lower position of the first tamper to correspond substantially to the second upper position of the second tamper, whereby coarser grains in the asphalt mix are embedded and undergo minimal longitudinal displacement, as the paver moves.

8. A method of compacting an asphalt mix having a mixture of coarse and smaller sized grains using a mobile paver moving in a direction of travel, the method comprising:

a. providing a first tamper having a generally horizontal tamping surface and being reciprocally movable between a first upper position and a first lower position;

b. providing a second tamper positioned behind the first tamper in the direction of paver travel, having a generally horizontal tamping surface and being reciprocally movable between a second upper position and a second lower position;

c. configuring the two tampers such that the first lower position of the first tamper is substantially vertically aligned with the second upper position of the second tamper;

d. reciprocating the first tamper between the first tamper lower position and the first tamper upper position; and e. reciprocating the second tamper between the second tamper upper position and the second tamper lower position;

whereby coarser grains in the asphalt mix are embedded and undergo minimal longitudinal displacement, as the paver moves.

9. The method as recited in claim 8 wherein at least one of the tampers has an eccentric drive with an adjustable stroke and the step of configuring the two tampers includes adjusting the eccentric drive to adjust the stroke of the one tamper.

* * * * *